US007931415B2

(12) United States Patent
Namiki et al.

(10) Patent No.: US 7,931,415 B2
(45) Date of Patent: Apr. 26, 2011

(54) KNOCK-TYPE WRITING INSTRUMENT HAVING A SHOCK-RELAXING DEVICE

(75) Inventors: Yoshiharu Namiki, Yokohama (JP); Hisami Tamano, Yokohama (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 0 days.

(21) Appl. No.: 12/733,264

(22) PCT Filed: Aug. 11, 2008

(86) PCT No.: PCT/JP2008/064660

§ 371 (c)(1),
(2), (4) Date: Feb. 19, 2010

(87) PCT Pub. No.: WO2009/025248

PCT Pub. Date: Feb. 26, 2009

(65) Prior Publication Data

US 2010/0150638 A1 Jun. 17, 2010

(30) Foreign Application Priority Data

Aug. 20, 2007 (JP) ..... 2007-213767

(51) Int. Cl.
*B43K 5/16* (2006.01)
*B43K 7/12* (2006.01)
*B43K 24/02* (2006.01)

(52) U.S. Cl. ..... 401/106; 401/104; 401/110; 401/111

(58) Field of Classification Search ..... 401/99, 401/104–106, 110–113, 209, 214, 216
See application file for complete search history.

(56) References Cited

U.S. PATENT DOCUMENTS 5,713,680 A 2/1998 Yoshino et al.
5,871,296 A * 2/1999 Furukawa et al. ..... 401/106

(Continued)

FOREIGN PATENT DOCUMENTS

DE 20 40 970 A1 2/1972

(Continued)

OTHER PUBLICATIONS

International Search Report dated Sep. 16, 2008, in PCT/JP2008/064660, 2 pages.

(Continued)

*Primary Examiner* — David J. Walczak
*Assistant Examiner* — Keegan Gumbs
(74) *Attorney, Agent, or Firm* — Foley & Lardner LLP

(57) ABSTRACT

Upon depressing a knock rod in a state of writing of FIG. 8A, a cam protuberance 3*b* of a rotor turns rightward to assume a position shown in FIG. 8B. Upon removing a finger, the cam protuberance 3*b* turns sliding on a tilted surface, arrives at a position shown in FIG. 8C through a first vertical motion (distance d) and, further, arrives at a position shown in FIG. 8D through a second vertical motion (distance e). Here, a tilted surface of cam protuberance 3*b* comes in collision with a tilted surface of an inner cylinder cam 2*b* twice, and shocks are transmitted to a refill 7. By forming a step between the front half and the rear half of the tilted surface of the inner cylinder cam 2*b*, however, a distance of vertical motion of the cam protuberance 3*b* each time is shortened to decrease the shock of collision imparted to the refill each time.

1 Claim, 10 Drawing Sheets

U.S. PATENT DOCUMENTS

| | | | | |
|---|---|---|---|---|
| 6,336,761 | B1 * | 1/2002 | Kudo | 401/106 |
| 2005/0276652 | A1 | 12/2005 | Kanari et al. | |

FOREIGN PATENT DOCUMENTS

| | | | |
|---|---|---|---|
| DE | 93 08 074 | U1 | 7/1993 |
| JP | 58-24500 | A | 3/1983 |
| JP | 62-60386 | U | 4/1987 |
| JP | 8-127194 | A | 5/1996 |
| JP | 2004-255682 | A | 9/2004 |
| JP | 2005-193585 | A | 7/2005 |
| JP | 2008-100410 | A | 5/2008 |

OTHER PUBLICATIONS

Supplementary European Search Report dated Oct. 22, 2010, in corresponding EP 08792506.1, 6 pages.

* cited by examiner

KNOCK-TYPE WRITING INSTRUMENT HAVING A SHOCK-RELAXING DEVICE

CROSS-REFERENCE TO RELATED APPLICATIONS

This application is a National Stage application of PCT/JP2008/064660, filed Aug. 11, 2008, which claims priority from Japanese application JP 2007-213767, filed Aug. 20, 2007.

TECHNICAL FIELD

This invention relates to a knock-type writing instrument and, particularly, to a knock-type writing instrument having a mechanism for relaxing shocks imparted to a refill when a knock is released and a safety is released.

BACKGROUND ART

A safety mechanism stands for a mechanism which when a tip of the clip is lifted up in a state where the pen point of the refill is at the writing position protruding beyond the end of the holder, the pen point draws back into the holding position in the holder. By this mechanism, clothing will not be stained in case the writing instrument is inserted in, for example, a chest pocket of a clothing with the pen point staying out at fault.

Several types of knock-type writing instruments are known. One of them is a Kahn knock-type writing instrument in which if a knocking operation is carried out with the pen point in the writing position and the knock rod is released (hereinafter referred to as "return operation"), a rotor is pushed back by the force of a spring, and a cam protuberance 3*b′* of the rotor moves vertically along an inner cylinder cam 2*b′* (over a distance a, in the axial direction only) to place the pen in a pen point-holding position (see FIG. 11).

However, due to the above vertical motion of when the knock is released (return operation), a shock is imparted to a refill (ink container). When the refill contains an aqueous ink or a gel ink, in particular, the ink in the refill can be displaced or leak out, whereby air may become trapped in the end of the refill which can result in blurred writing. Therefore, it has been desired to devise a mechanism to reduce the shock caused by the vertical motion.

With a Kahn knock-type writing instrument equipped with a safety function, the writing position is maintained as the tip of the clip is engaged to limit the motion of the rotor. In the return operation, the cam protuberance 3*b′* of the rotor vertically moves along the inner cylinder cam 2*b′* (by a distance a, in the axial direction only) to establish the pen point-holding position, like an ordinary Kahn knock-type instrument. Here, if the safety release operation is effected (hereinafter referred to as "safety operation") by lifting up the tip of the clip, however, the motion of the rotor is no longer limited, and the cam protuberance of the rotor vertically moves up to the pen point-holding position. In the case of a cam constitution shown in FIG. 12, for instance, a cam protuberance 3*b′* vertically moves (distance i) together with a slide body 6*a′*.

A shock is imparted to the refill (ink container) even by the collision of when the cam protuberance vertically moves during the safety operation giving rise to the occurrence of the problem described above. Therefore, it has been desired to provide a mechanism for relaxing shocks in the vertical motion.

Japanese Unexamined Patent Publication JP-A-2000-218989, on the other hand, discloses a knock-type writing instrument with safety using a spring as a buffer member.

This system, however, is accompanied by a problem of an increase in the number of parts. The aqueous ink and the gel ink have recently been frequently used, and it has been desired to solve the above inconveniences caused by shocks relying on simple systems.

DISCLOSURE OF THE INVENTION

An object of this invention is to solve the above problems and to provide a knock-type writing instrument capable of relaxing shocks without increasing the number of parts by contriving the shapes of the cams irrespective of if the writing instrument does not have a safety mechanism or has a safety mechanism.

According to the present invention, there is provided a knock-type writing instrument comprising a refill having a writing portion at a front end thereof, a spring for urging the refill backward, and a knock rod that is arranged at the back of the refill and is linked to the refill and protrudes beyond the rear end of a holder, wherein upon depressing the knock rod, the refill is brought to a writing position protruding beyond the front end of the holder; and wherein a rotor is provided between the knock rod and the refill to support the refill, the knock rod and the rotor have tilted cam surfaces for rotation corresponding to each other, and the rotor rotates in only one direction by only a predetermined angle each time due to the reactive force of the spring and responsive to the knocking operation forward and backward in the axial direction; when the knocking operation is effected in a state where the refill has been drawn back into the holder, a tilted cam surface for positioning formed on the side surface of a cylindrical portion of the rotor comes in contact with a first tilted surface of the cam formed in an inner cylinder corresponding thereto, a vertical surface of the cam for positioning of the rotor comes in contact with a vertical wall of a cam formed in the inner cylinder and maintains the refill at the writing position being supported by the load in the axial direction and by the rotational force; when the knocking operation is effected in a state where the refill is at the writing position, the tilted cam surface for positioning of the rotor comes in contact with a second tilted surface of the cam formed in the inner cylinder continuing to the vertical wall of the cam and, further, rotates upon coming in contact with a third tilted surface of the cam formed in the inner cylinder, and moves to a retreated limit position to maintain the refill at the holding position; wherein the third tilted surface of the cam formed in the inner cylinder has a step in the axial direction.

According to the present invention, there is further provided a knock-type writing instrument comprising a refill having a writing portion at a front end thereof, a spring for urging the refill backward, and a knock rod that is arranged at the back of the refill and is linked to the refill and protrudes beyond the rear end of a holder, wherein upon depressing the knock rod, the refill is brought to a writing position protruding beyond the front end of the holder and an engaging nub of a clip is engaged with an engaging protuberance of a slide body to maintain the writing position; and wherein a rotor is provided between the knock rod and the refill to support the refill, the knock rod and the rotor have tilted cam surfaces for rotation corresponding to each other, and the rotor rotates in only one direction by a predetermined angle each time due to the reactive force of the spring, and responsive to the forward and backward knocking operation in the axial direction; when the knocking operation is effected in a state where the refill has been drawn back into the holder, a tilted cam surface formed on the side surface of a cylindrical portion of the rotor comes in contact with a first tilted surface of the cam formed in an inner cylinder corresponding thereto and with a tilted cam surface formed on the slide body by rotation, a vertical surface of the cam for positioning of the rotor comes in contact with a vertical wall of a cam formed in the holder and maintains the refill at a writing position being supported by the load in the axial direction and by the rotational force; when the knocking operation is effected in a state where the refill is at the writing position, the tilted cam surface for positioning of the rotor comes in contact with a tilted cam surface formed in the holder, and further, rotates upon coming in contact with a second tilted surface of the cam formed in the inner cylinder, and moves to a retreated position to maintain the refill at the holding position; the slide body that can move in the lengthwise direction has an inward protuberance in a cut-away portion of the holder and when the refill is at the writing position, the inward protuberance is brought into engagement with a rear end of the cam for positioning of the rotor, and an engaging protuberance formed on the slide body engages with an engaging step formed in a clip body to maintain the refill at the writing position; when the engagement is released between the engaging protuberance of the slide body and the engaging step of the clip body, the refill is returned by the spring back to the retreated position together with the slide body, and the positioning cam of the rotor moves to the retreated position passing through a gap formed at the back of the tilted cam surface of the holder to maintain the refill at the holding position; wherein the second tilted surface of the cam formed in the inner cylinder has a step in the axial direction.

BEST MODE FOR CARRYING OUT THE INVENTION

The embodiments of the invention will now be concretely described based on the drawings. First, the basic construction and operation will be described and next, the characteristic parts of the embodiments will be described.

Figure 1A:
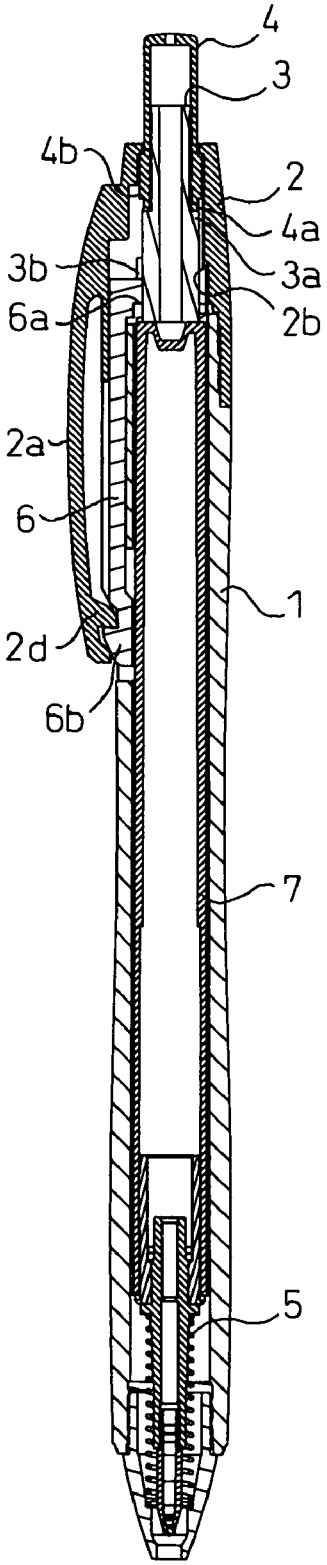
FIG. 1A is a sectional view of a knock-type writing instrument according to second and third embodiments, and shows a state where a refill is at the holding position.
Figure 1B:
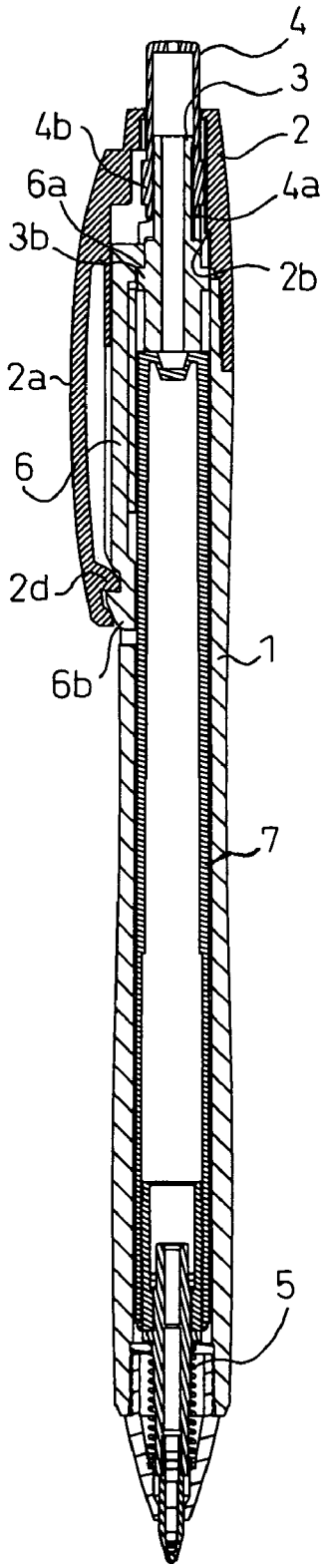
FIG. 1B is a sectional view of the knock-type writing instrument according to the second and third embodiments, and shows a state where the refill is at the writing position.

A first embodiment does not have a safety mechanism, and therefore is not equipped with a slide body 6 of FIGS. 1A and 1B. Therefore, this portion is occupied by a holder 1.

Referring to FIGS. 1A and 1B (the safety mechanism is not shown), the first embodiment includes a refill 7 having a writing portion at an end thereof, a spring 5 for urging the refill backward, and a nock rod 4 that is linked to the refill 7 and protrudes beyond the holder 1. Upon depressing the knock rod 4, the refill 7 is brought to a writing position protruding beyond the front part of the holder 1.

A rotor 3 is provided between the knock rod 4 and the refill 7 in front thereof to support the refill 7. The knock rod 4 and the rotor 3 have a knock rod cam 4*a* and a knock cam 3*a* forming tilted cam surfaces corresponding to each other, and the rotor 3 rotates in only one direction by only a predetermined angle each time responsive to the forward knocking operation in the axial direction.

Further, when no longer depressed after the knocking operation, the refill 7 is urged backward by the spring 5 and rotates in the same direction as the direction in which the knock rod 4 and the rotor 3 rotate due to a cam protuberance 3*b* of the rotor 3 and a corresponding cam 2*b* of an inner cylinder 2. That is, the rotor 3 rotates by a predetermined angle, and rotates once at a given timing (after two times of knocking in this embodiment) to repeat the operation.

The constituent parts will be described below in detail.

Figure 2:
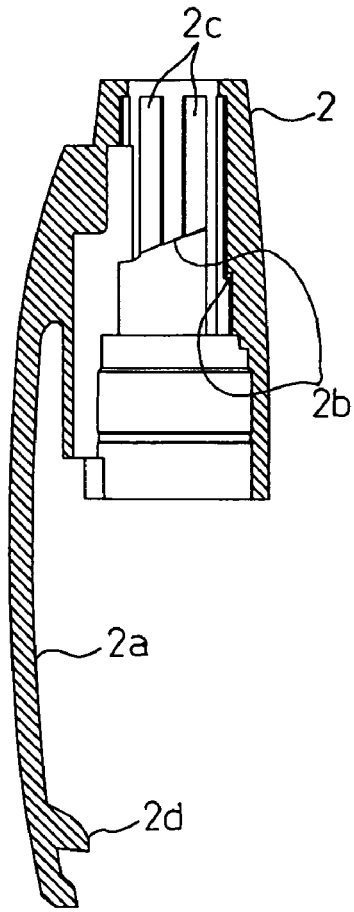
FIG. 2 is a sectional view of a clip in FIG. 1.
Figure 3A:
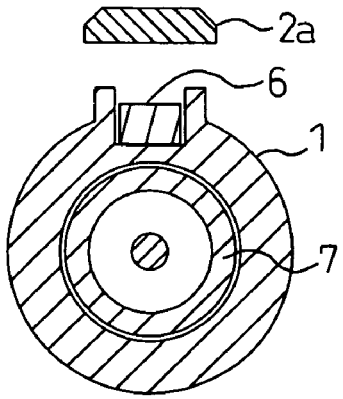
FIG. 3A is a sectional view along the A-A section of FIG. 1.
Figure 3B:
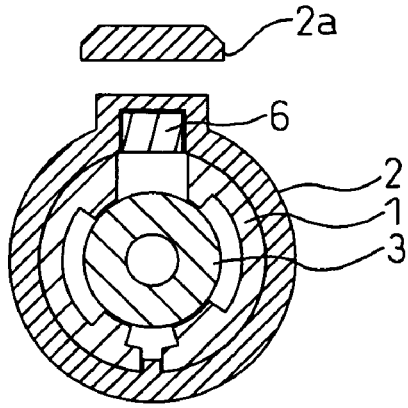
FIG. 3B is a sectional view along the B-B section of FIG. 1.

The inner cylinder 2 shown in FIGS. 1A, 1B and 2 is constituted integrally with a clip 2*a*. On the inner wall surface of the inner cylinder, there are arranged grooves 2*c* for stopping the turn of the knock rod 4 and an inner cylinder cam 2*b* for positioning the refill 7. The shape of the inner cylinder cam 2*b* will be described later in detail.

Figure 4:
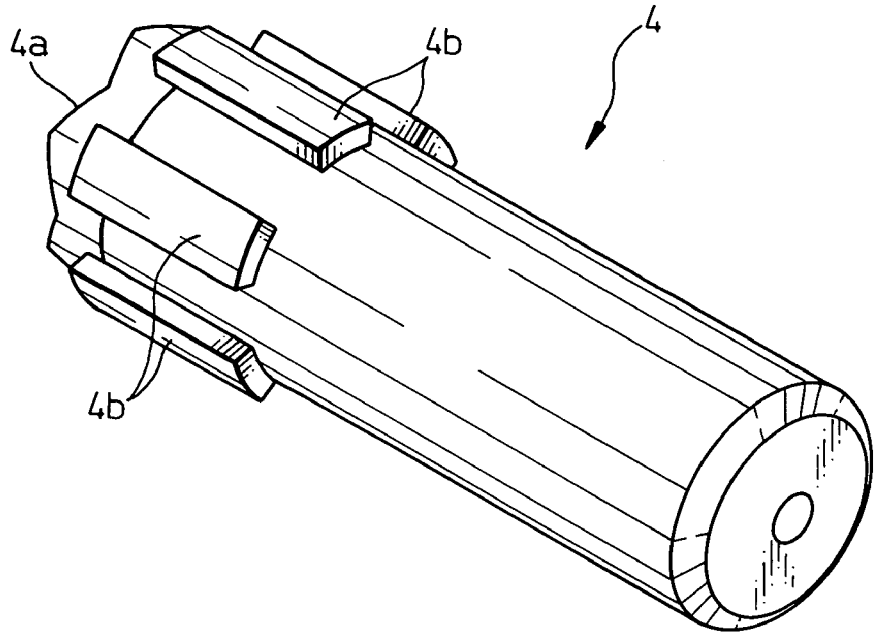
FIG. 4 is a perspective view of a knock rod in FIG. 1.

The knock rod 4 shown in FIGS. 1A, 1B and 4 is a cylindrical member disposed at the tail end of the writing instrument, and has a knock rod cam 4*a* at an end portion thereof and turn stops 4*b* arranged on the outer circumferential portion near the end thereof to slide in the grooves 2*c*.

Figure 5:
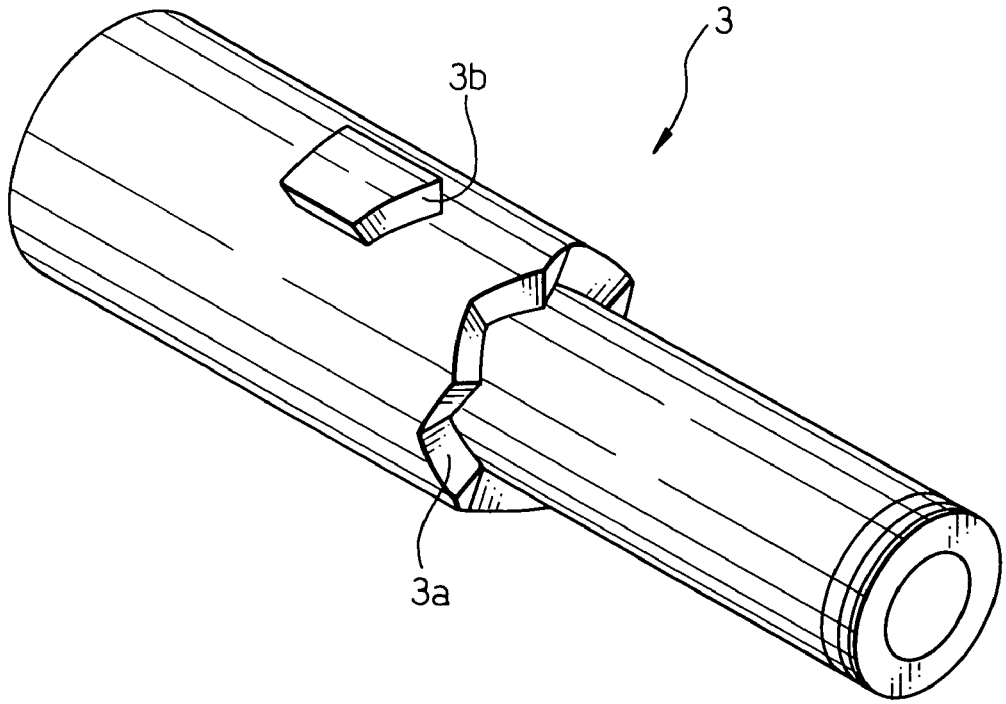
FIG. 5 is a perspective view of a rotor in FIG. 1.
Figure 6:
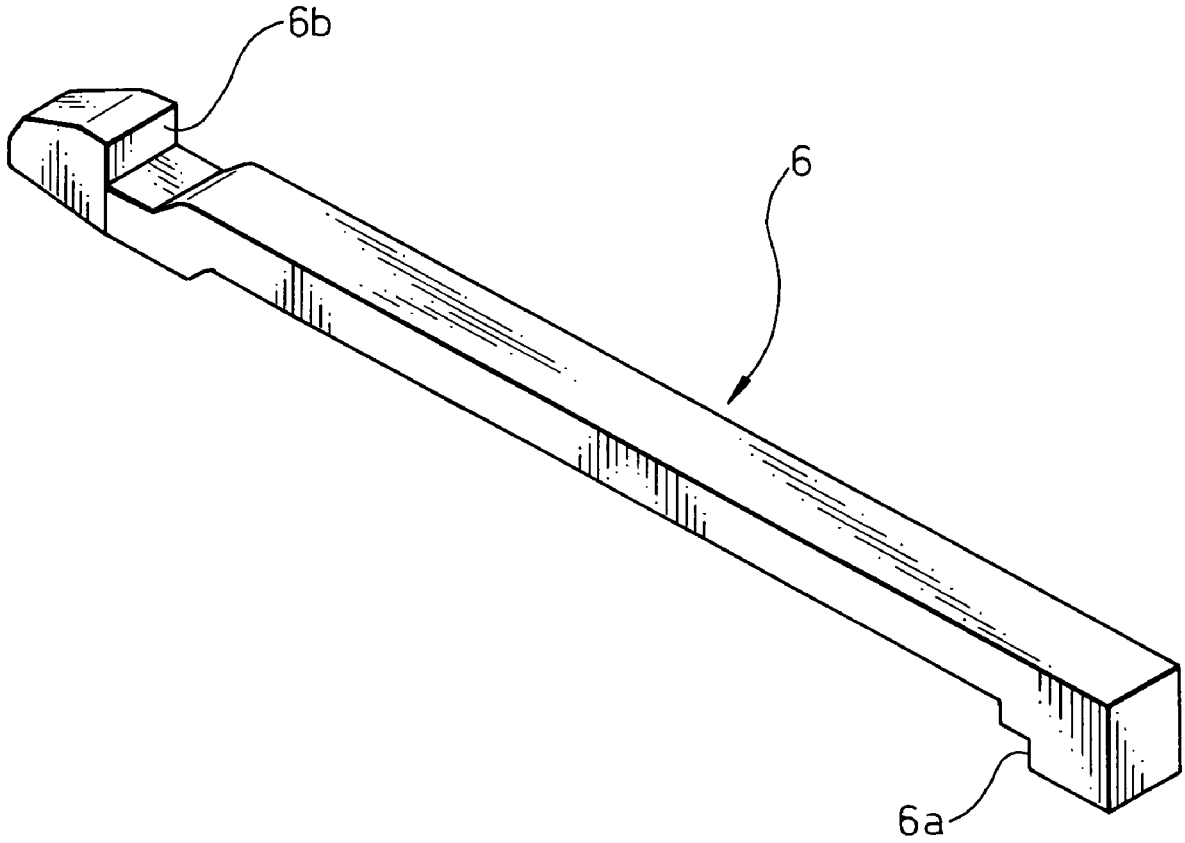
FIG. 6 is a perspective view of a slide body in FIG. 1.

The rotor 3 shown in FIGS. 1A, 1B and 5 is a cylindrical member having a knock cam 3*a* that comes in contact with the knock rod cam 4*a* of the knock rod 4 and a cam protuberance 3*b* for positioning the refill 7.

A spring 5 is arranged in an end of the holder 1 to urge the refill 7 toward the knock rod 4.

The knock rod cam 4*a* and the knock cam 3*a* have mountain-shaped tilted cam surfaces corresponding to each other, and are arranged with their mountain-shaped pitches being deviated, whereby the rotor 3 receives a rotational force in a predetermined direction responsive to the knocking operation in the axial direction. Therefore, the rotor 3 rotates in a predetermined direction responsive to each knocking operation accompanied by the operation of the cam protuberance 3*b* that will be described later.

Further, the end portion of the rotor 3 is in contact with the rear end portion of the refill 7 at all times, and the front and rear positions of the cam protuberance 3*b* determine the pen point position at the end of the refill 7.

Next, the action of the thus constituted knock-type writing instrument will be described.

The knocking operation is an operation of depressing the knock rod 4 until it is released therefrom, and i.e., a case where the pen point is moved from the retreated state to the writing position. On the other hand, the knock release is an operation of similarly depressing the knock rod 4 until it is released, i.e., a case where the pen point is moved from the writing position to the holding position.

Upon knock-operating the knock rod 4, the rotor 3 and the refill 7 move forward being pushed by the knock rod. As described above, the rotor 3 is imparted with a rotational force (due to a relationship between the knock rod cam 4*a* and the knock cam 3*a*) but is restricted from rotating by a vertical wall of the inner cylinder cam 2*b*. If the cam protuberance 3*b* of the rotor 3 moves forward to a position beyond the vertical wall of the inner cylinder cam 2*b*, there is no restriction and the rotor 3 slightly rotates.

When rod 4 is released, the cam protuberance 3*b* of the rotor 3 undergoes a rotational motion along the inner cylinder cam 2*b*. In the ordinary Kahn knock type writing instrument, the inner cylinder cam 2*b* has been cut so that the rotation stops at the writing position upon hitting the vertical wall of the inner cylinder cam 2*b*. At a moment when the rotation stops, the pen point at the end of the refill 7 assumes the writing position shown in FIG. 7A.

Next, described below with reference to FIGS. 7A to 7E are the constitution of the inner cylinder cam 2*b* which is a characteristic part of the embodiment and the operation of the cam protuberance 3*b* of the rotor 3 which undergoes the rotational motion and the vertical motion while in contact with the inner cylinder cam 2*b* in the return operation after the knock is released.

The drawings show the positions of the cam protuberance 3*b* of the rotor 3 with respect to development of the inner cylinder cam 2*b* formed on the inner surface of the inner cylinder 2. The upper side in the drawings is the direction of the pen point. The cam protuberance 3*b* of the rotor 3 is imparted with the rotational force due to the cam mechanism of the knock rod 4 and the rotor 3, and therefore moves from the left toward the right in the drawing every knocking operation.

Figure 7A:
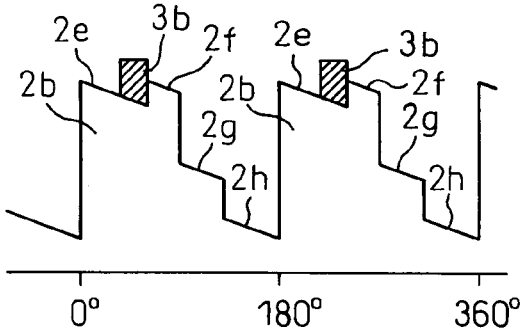
FIGS. 7A to 7E are schematic views illustrating the motions of a cam protuberance according to a first embodiment.

FIGS. 7A to 7E show the motions of the cam protuberance 3*b* of the rotor 3 in the return operation. FIG. 7A shows a state where the pen point is protruded to assume the state of writing, and the cam protuberance 3*b* is fixed being pushed onto a first tilted surface 2*e* and onto the vertical wall of the inner cylinder cam 2*b* by the reactive force of the spring 5.

If the knock rod 4 is depressed in this state, the cam protuberance 3*b* moves upward in the drawing and reaches a position beyond the vertical wall of the inner cylinder cam 2*b*. Thereafter, the cam protuberance 3*b* is no longer restricted by the vertical wall of the inner cylinder cam 2*b*, and rotates toward the right and is pushed onto a second tilted surface 2*f* of the inner cylinder cam 2*b* as shown in FIG. 7B due to the reactive force of the spring 5 and the action of the tilted cam surface for rotation.

Figure 7D:
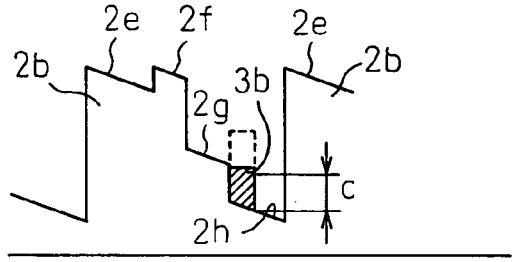
Figure 7B:
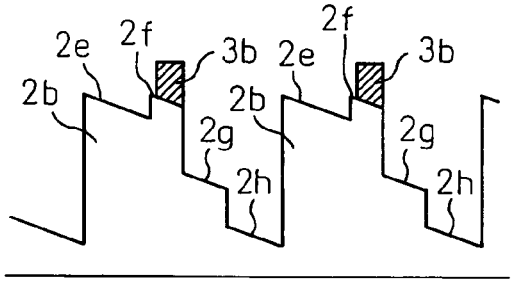
Figure 7E:
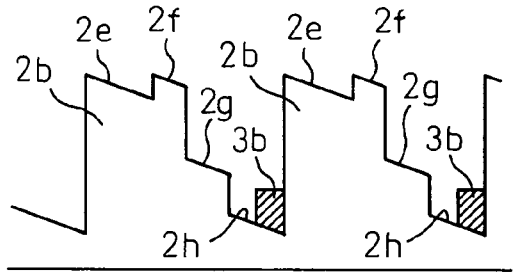
Figure 7C:
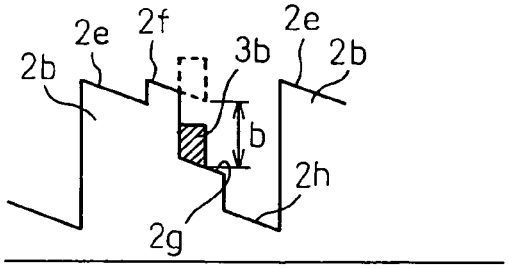

When pressure is released, the cam protuberance 3*b*, further, rotates and reaches a position shown in FIG. 7C passing through a first vertical motion. At this moment, the tilted surface of the cam protuberance 3*b* comes into collision with a front half portion 2*b* of a third tilted surface (hereinafter referred to as "front half tilted surface") of the inner cylinder cam 2*b*, and a shock is transmitted to the refill 7.

Further, the cam protuberance 3*b* rotates sliding on the front half tilted surface 2*g* of the inner cylinder cam 2*b* and reaches a position shown in FIG. 7D passing through a second vertical motion. At this moment, the tilted surface of the cam protuberance 3*b* comes into collision again with a rear half portion 2*h* of the third tilted surface (hereinafter referred to as "rear half tilted surface") of the inner cylinder cam 2*b*, and a shock is transmitted to the refill 7.

Thereafter, the cam protuberance 3*b* rotates sliding on the rear half tilted surface 2*h* of the inner cylinder cam 2*b*, and halts coming in contact with the vertical wall of the inner cylinder cam 2*b* and arrives at a pen point-holding position shown in FIG. 7E.

Previously, the above collision has occurred only once, and the distance of the vertical motion of prior art was nearly equal to the sum of distances of vertical motions at the two portions in the above constitution of the present invention. By providing a step in the axial direction between the front half and the rear half of the third tilted surface of the inner cylinder cam 2*b* as described above, the distance of each vertical motion of the cam protuberance 3*b* can be shortened.

Table 1 shows the distances b, c of vertical motions at two portions in the above constitution and the degrees of shocks of collision at these portions. In Table 1, the "number of bubbles that have evolved" is the number of bubbles in the refill 7 when the return operation or the safety operation is repeated 50 times, and is an average value of when the testing is conducted five times (n=5). This value is employed as a parameter for comparing the degrees of shocks.

It will be learned from Table 1 that according to the embodiment, the distance of vertical motion per each time is shortened compared to that of the conventional Kahn knock type, and the number of bubbles that have evolved is decreased. This means that the embodiment prevents the above-mentioned inconvenience caused by a shock in the return operation.

The shock is relaxed presumably based on a mechanism in that upon dividing the vertically moving portion (into two in this embodiment), the final speed of the vertical motion of each time can be decreased compared to when not divided, and therefore the shock of collision can be decreased.

Another mechanism is that upon the motion on the tilted surface in addition to the vertical motion, the reactive force of the spring is divided into a component along the tilted surface, whereby the speed in the direction of the tilted surface (Vt) becomes lower than the speed of the vertical motion. Therefore, the velocity component of Vt in the vertical direction further decreases.

The problem is a shock in the vertical direction which brings down inconvenience in the state of ink in the refill. On the other hand, the shock in the transverse direction due to the speed in a horizontal direction does not cause the problem. However, being limited by a space, it is not allowed to transform all motions into the motion along the tilted surface so as to eliminate the vertically moving portion. Therefore, the problem is ascribable to the arrangement of the vertically moving portions, and the constitution of the present invention was attained by proving the above consideration achieved through a test for confirming the degrees of shocks.

Next, as a second embodiment, described below is an embodiment of the invention of claim 2 concerned to the knock-type writing instrument having a safety mechanism and, further, having a shock-relaxing mechanism. First, general constitution and action of this embodiment will be described and next, characteristic parts of the embodiments will be described.

Provision of the safety mechanism makes the constitution of this embodiment different from the constitution of the above first embodiment and, therefore, makes the arrangement of the cam slightly different correspondingly. This will be described below. Common constituent parts other than the above are denoted by the same reference numerals, and common actions are not described here again.

Figure 1C:
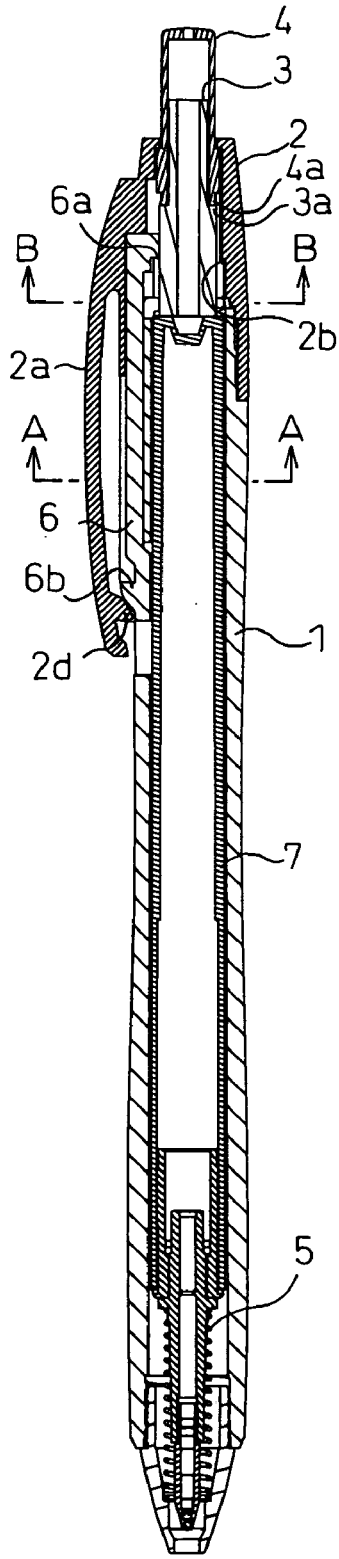
FIG. 1C is a sectional view of the knock-type writing instrument according to the second and third embodiments, and shows a state where the refill is at the holding position after the safety operation.

As shown in FIGS. 1A to 1C, the knock rod 4 is depressed to bring the refill 7 to the writing position protruding beyond the front part of the holder 1 in the same manner as in the first embodiment. This embodiment, however, makes a difference in that an engaging nub 2*d* of the clip engages with an engaging protuberance 6*b* of a slide body 6 so that the reactive force of the spring 5 and the partial force of the writing load in the axial direction are supported by a slide body cam 6*a* that will be described later and that the partial force in the rotational direction is supported by a holder cam 1*a* that will be described later and that is provided on the inner wall of the holder 1 to thereby hold the write-enabling state.

The embodiment, however, is the same in regard to that the knock rod 4 and the rotor 3 have the knock rod cam 4*a* and the knock cam 3*a* which are the tilted cam surfaces corresponding to each other, and the rotor 3 rotates in one direction only by only a predetermined angle each time responsive to the forward knocking operation in the axial direction.

Constituent parts will be described hereinbelow.

In this embodiment, the inner cylinder 2 shown in FIGS. 1A to 1C and 2 is constituted integrally with a clip 2*a*. On the inner wall surface of the inner cylinder, there are arranged grooves 2*c* for stopping the turn of the knock rod 4 and an inner cylinder cam 2*b* for positioning the refill 7. The shape of the inner cylinder cam 2*b* will be described later in detail. Further, an engaging nub 2*d* for engagement with the slide body 6 is formed at an end of the clip 2*a*.

The knock rod 4 shown in FIGS. 1A to 1C and 4, and the rotor 3 shown in FIGS. 1A to 1C and 5 have the constitutions and actions that are the same as those of the first embodiment.

The slide body 6 shown in FIGS. 1A to 1C, 3A, 3B and 6 is a rod-like member which is provided in a cut-away portion (cross section A-A) formed in the holder 1 on the inside of the clip 2*a* as shown in FIGS. 1A to 1C and 3A and 3B, and is exposed to the outer side of the holder 1. The rear end portion of the slide body 6 is fitted in a groove formed in the inner surface of the inner cylinder 2 so as to slide therein (cross section B-B).

The slide body 6 has a slide body cam 6*a* at a rear end on the inside thereof and with which will come in contact the cam protuberance 3*b* of the rotor 3, and, further, has an engaging protuberance 6*b* at an end on the outer side thereof and with which will come in engagement the engaging nub 2*d* of the clip 2*a*.

Next, the action of the thus constituted knock-type writing instrument will be described.

If the knock rod 4 is depressed from a state where the pen point has been into the holder 1, and then released, the cam protuberance 3*b* of the rotor 3 undergoes a rotational motion along the inner cylinder cam 2*b*. The cam protuberance 3*b* of the rotor 3 comes in contact with the vertical wall of the holder cam 1*a* and stops rotating. At a position where the rotation stops, the pen point at the end of the refill 7 is brought to a writing position shown in FIGS. 8A and 9A.

At this moment, further, the cam protuberance 3*b* of the rotor 3 is on the slide body cam 6*a* moving from the inner cylinder cam 2*b*. The load exerted on the rotor 3 in the axial direction thereof, i.e., the load due to the reacting force of the spring 5 and the writing, is transmitted from the cam protuberance 3*b* of the rotor 3 to the slide body cam 6*a*, and is supported by a portion where the engaging protuberance 6*b* of the slide body 6 is in engagement with the engaging nub 2*d* of the clip 2*a*.

Next, constitutions of the cams which are characteristic parts of the embodiment and the motion of cam protuberance 3*b* of the rotor 3 in the return operation after the knock is released, will be described with reference to FIGS. 8A to 8E.

FIGS. 8A to 8E are schematic views illustrating positional relationships among the cam protuberance 3*b* of the rotor 3, inner cylinder cam 2*b*, holder cam 1*a* and slide body cam 6*a*, and show the arrangement of the cam protuberance 3*b* of the rotor 3, holder cam 1*a* and slide body cam 6*a* with respect to the development of the inner cylinder cam 2*b* formed on the inner surface of the inner cylinder 2.

Unlike that of FIGS. 7A to 7E, the inner cylinder cam 2*b* of this embodiment has a groove 2*i* for slide body cam of a safety mechanism, has a wall of the groove 2*i* that becomes lower in the direction of rotation, and is provided with an opening relative to the holder cam 1*a* on the upper side. The upper end of the above wall is connected to a front half wall 2*g* of the second tilted surface. The action of this portion will be described later with reference to the safety operation.

Figure 8A:
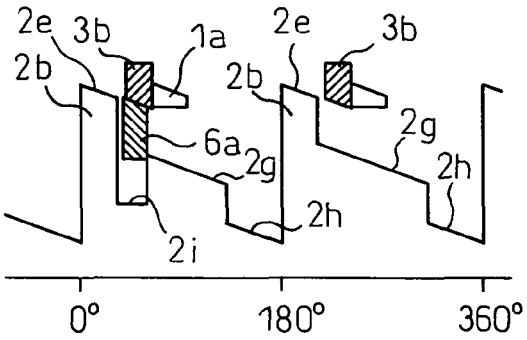
FIGS. 8A to 8E are schematic views illustrating the motions of the cam protuberance in the return operation according to the second embodiment.

FIGS. 8A to 8E illustrate the motions of the cam protuberance 3*b* of the rotor 3 in the return operation. FIG. 8A shows a state where the pen point is protruded for writing, wherein the cam protuberance 3*b* is fixed being pushed, in the axial direction, onto the tilted surface of the slide body cam 6*a* arranged at a position continuous to the first tilted surface of the inner cylinder cam 2*b* and being pushed, in the rotational direction, onto the vertical wall of the holder cam 1*a* due to the reactive force of the spring 5.

If the knock rod 4 is depressed in this state, the cam protuberance 3*b* of the rotor 3 moves upward in the drawing, arrives at a position exceeding the vertical wall of the holder cam 1*a* and is, thereafter, no longer limited by the vertical wall of the holder cam 1*a*. Due to the reactive force of the spring 5 and the action of the above tilted cam surface for rotation, therefore, the cam protuberance 3*b* of the rotor 3 rotates toward the right and is pushed onto the tilted surface of the holder cam 1*a* as shown in FIG. 8B.

Figure 8D:
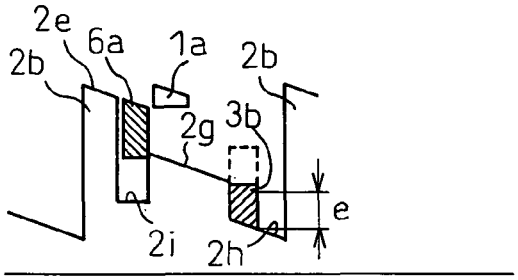
Figure 8B:
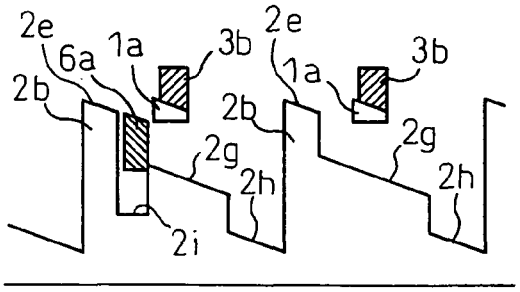
Figure 8E:
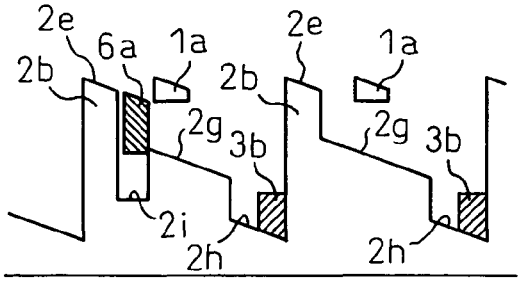
Figure 8C:
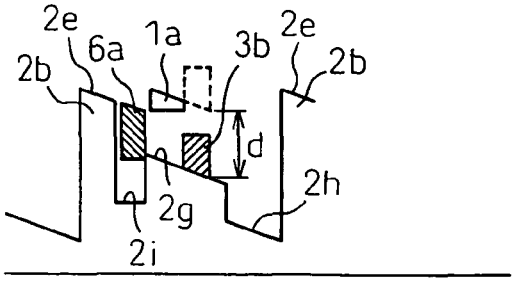

When pressure is released, the cam protuberance 3*b* further rotates and arrives at a position shown in FIG. 8C passing through a first vertical motion. At this moment, the tilted surface of the cam protuberance 3*b* comes into collision with the front half portion of the second tilted surface (hereinafter referred to as "front half tilted surface") 2*g* of the inner cylinder cam 2*b*, and a shock is transmitted to the refill 7.

Further, the cam protuberance 3*b* rotates sliding on the front half tilted surface 2*g* of the inner cylinder cam 2*b*, and arrives at a position shown in FIG. 8D passing through a second vertical motion. At this moment, the tilted surface of the cam protuberance 3*b* collides again with the rear half portion of the second tilted surface (hereinafter referred to as "rear half tilted surface") 2*h* of the inner cylinder cam 2*b*, and a shock is transmitted to the refill 7.

Thereafter, the cam protuberance 3*b* rotates sliding on the rear half tilted surface 2*h* of the inner cylinder cam 2*b*, and halts coming in contact with the vertical wall of the inner cylinder cam 2*b*, i.e., arrives at a pen point-holding position shown in FIG. 8E.

In this embodiment, too, like in the first embodiment, a step in the axial direction is provided between the front half and the rear half of the second tilted surface of the inner cylinder cam 2*b* so as to shorten the distance of vertical motion of the cam protuberance 3*b* per one time and, therefore, to decrease the shock imparted to the refill at the time of collision. The mechanism of relaxing the shock is the same as the one described above.

Table 1 shows the distances d, e of vertical motions at two places in the above constitution, and the numbers of bubbles evolved that serve as parameters of degrees of shocks of collision.

Further described below with reference to FIGS. 9A to 9E are the constitutions of the cams which are characteristic parts of the embodiment and motions of the cam protuberance 3*b* of the rotor 3 in the safety operation.

Figure 9A:
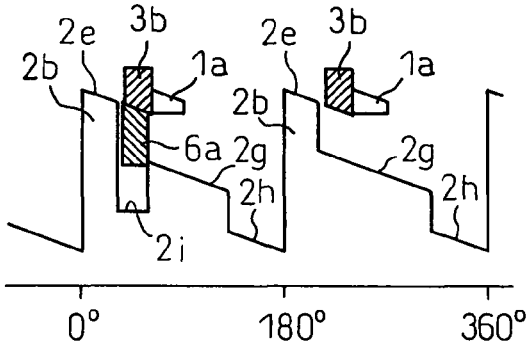
FIGS. 9A to 9E are schematic views illustrating the motions of the cam protuberance in the safety operation according to the second embodiment.

Like FIGS. 8A to 8E, FIGS. 9A to 9E illustrate the motions of the cam protuberance 3*b* of the rotor 3 in the safety operation. FIG. 9A shows a state where the pen point is protruded in the state of writing, wherein the cam protuberance 3*b* is fixed being pushed, in the axial direction, onto the tilted surface of the slide body cam 6*a* and being pushed, in the rotational direction, onto the vertical wall of the holder cam 1*a* due to the reactive force of the spring 5.

If the clip 2*a* is lifted up in the state shown in FIG. 9A, the engaging protuberance 6*b* of the slide body 6 is disengaged from the engaging nub 2*d* at the end of the clip 2*a* as described above. The refill 7, rotor 3 and slide body 6 move backward.

Figure 9D:
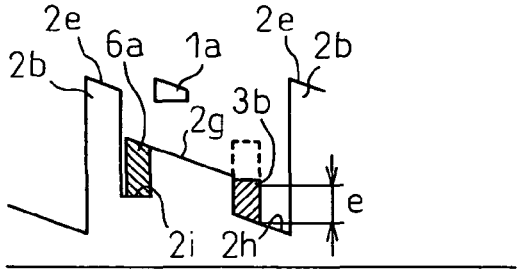
Figure 9B:
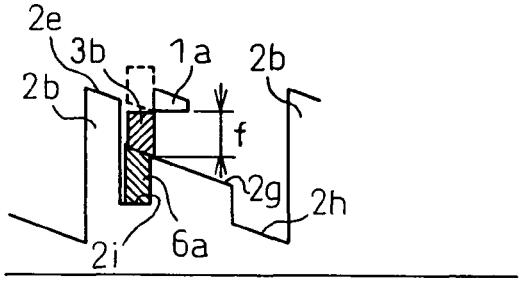

Referring to FIG. 9B, a first vertical motion is executed at a moment when the slide body 6 reaches the retreated limit together with the cam protuberance 3*b,* and a shock imparted to the cam protuberance 3*b* is transmitted to the refill 7. At the retreated limit at the same time, the cam protuberance 3*b* of the rotor 3 is no longer limited by the vertical wall of the holder cam 1*a* and is, therefore, allowed to rotate. Therefore, the cam protuberance 3*b* rotates rightward along the front half tilted surface 2*g* of the second tilted surface of the inner cylinder cam 2*b,* and assumes a state of FIG. 9C.

Figure 9E:
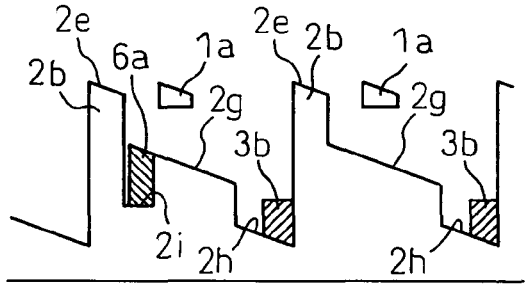
Figure 9C:
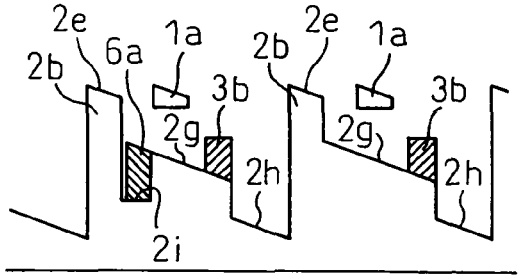

Due to the reactive force of the spring 5, the cam protuberance 3*b* undergoes a second vertical motion as shown in FIG. 9D, comes in collision with the rear half tilted surface 2*h* of the second tilted surface of the inner cylinder cam 2*b,* rotates along the rear half tilted surface 2*h,* and arrives at the holding position shown in FIG. 9E. After the safety mechanism has worked, the slide body 6 is pushed by the end of a turn stop 4*b* of the knock rod 4 responsive to the first knocking operation, and returns back to the predetermined position shown in FIG. 9A.

Upon dividing the second tilted surface of the inner cylinder cam 2*b* by a step into the front half and the rear half, the vertical motion that was so far effected one time is effected two times stepwise making it possible to greatly decrease the shock of collision per one time in the safety operation, too. Table 1 shows the distances f, e of vertical motions at the above two places and the numbers of bubbles evolved representing the degrees of shocks due to the collisions.

According to Table 1, the numbers of bubbles evolved in the embodiments are decreasing as compared to the prior art either in the case of return operation or in the case of safety operation, and the effect for relaxing shocks is obvious.

Next, another embodiment of the invention of claim 2 will be described as a third embodiment.

First, the constitution will be described with reference to FIGS. 10A to 10D.

Figure 10A:
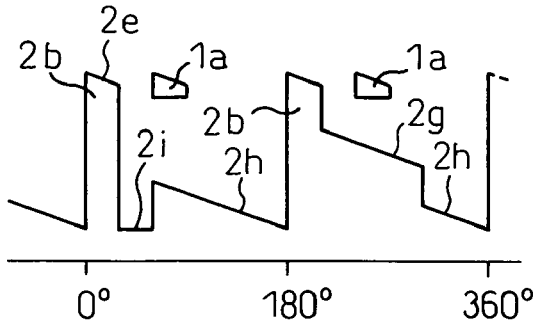
FIGS. 10A to 10D are schematic views illustrating the motions of the cam protuberance according to the third embodiment.

According to this embodiment as shown in FIG. 10A, of the two second tilted surfaces of the inner cylinder cams 2*b* at two places, only one second tilted surface is provided with a step to divide it into the front half and the rear half. The second tilted surface of the other place (on the side to where the groove for slide body 6 is neighboring) is provided with the rear half tilted surface provided for the other second tilted surface extending up to the front half portion.

The above constitution is to widen the gap between the holder cam la and the tilted surface 2*h* of the inner cylinder cam 2*b* neighboring the groove for slide body cam 6*a* so that the cam protuberance 3*b* is allowed to smoothly pass through the gap in the safety operation.

Figure 10B:
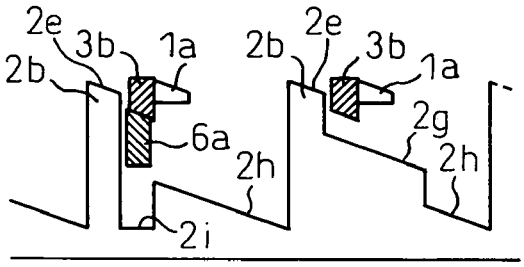
Figure 10C:
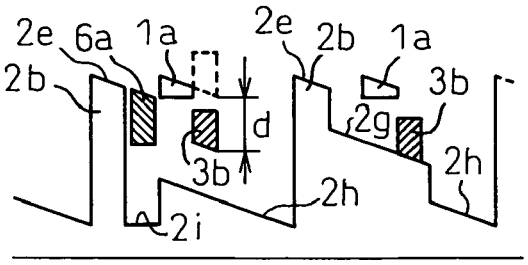

By employing the above constitution, the tilted surface of the inner cylinder cam 2*b* of the portion of the slide body cam 6*a* does not come into collision with the cam protuberance 3*b* in the first vertical motion (distance d) in the return operation as shown in FIG. 10C. The collision of the cam protuberance 3*b* occurs only with the tilted surface of the other inner cylinder cam 2*b.* In the second vertical motion (distance e), on the other hand, the collision of the cam protuberance 3*b* occurs with the tilted surfaces of the inner cylinder cams 2*b* at two places.

Figure 10D:
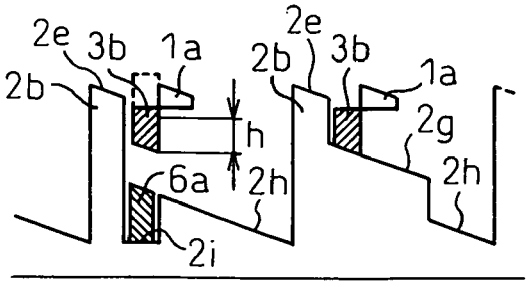
Figure 11A:
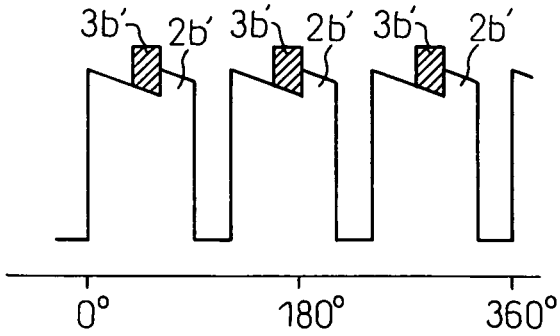
FIGS. 11A to 11D are schematic views illustrating the motions of the cam protuberance according to a conventional system.
Figure 11B:
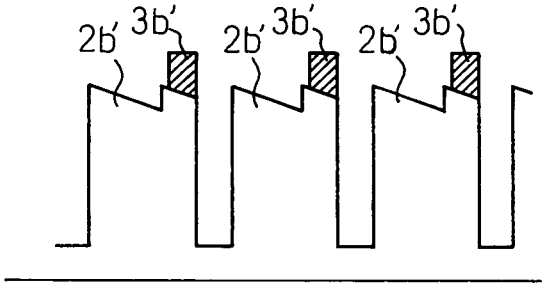
Figure 11C:
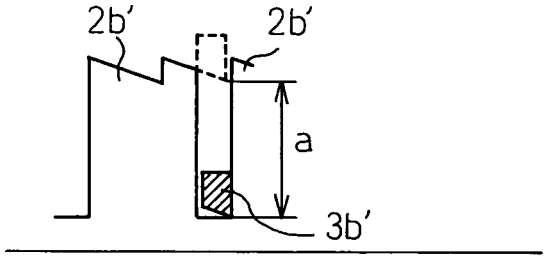
Figure 11D:
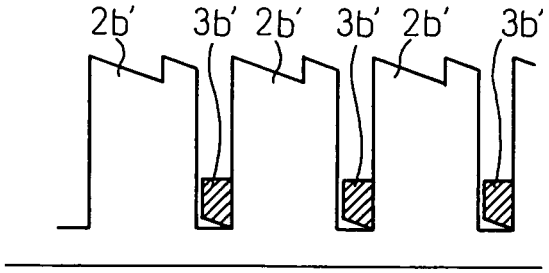
Figure 12A:
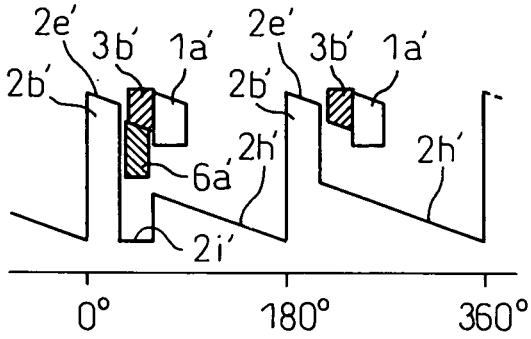
FIGS. 12A to 12D are schematic views illustrating the motions of the cam protuberance in a trial cam arrangement.
Figure 12B:
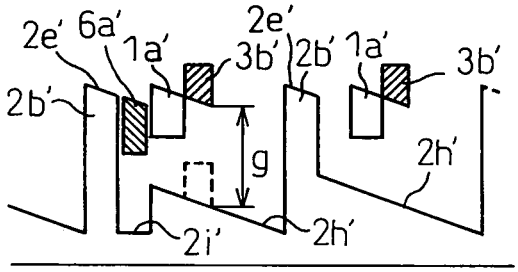
Figure 12C:
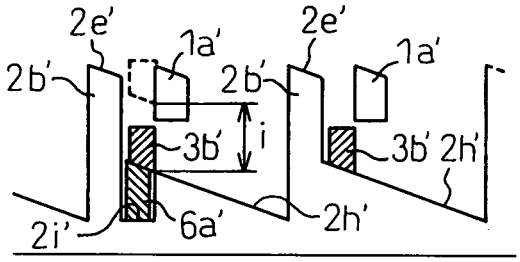
Figure 12D:
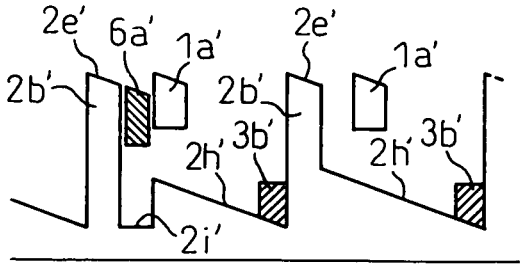

In the safety operation, further, the tilted surface of the inner cylinder cam 2*b* of the portion of the slide body cam 6*a* does not collide with the cam protuberance 3*b* in the first vertical motion (distance h) as shown in FIG. 10D. Collision of the cam protuberance 3*b* occurs only with the tilted surface of the other inner cylinder cam 2*b.* In the second vertical motion (distance e), on the other hand, the collision of the cam protuberance 3*b* occurs with the tilted surfaces of the inner cylinder cams 2*b* at two places.

Table 1 shows the distances of vertical motions of the case of the above constitution and the numbers of bubbles evolved representing the degrees of shocks by the collision. It will be learned that the shock is relaxed in this embodiment, too.

In the above constitution, the surfaces where the cam protuberance 3*b* and the slide body cam 6*a* are contacted together are further depressed to be lower than the first tilted surface of the inner cylinder cam 2*b* at the time of writing shown in FIG. 10B. This constitution is to reliably receive the partial force of the reactive force of the spring 5 exerted on the cam protuberance 3*b* in the rotational direction by the vertical wall of the holder cam 1*a,* by providing a predetermined play at a portion where the clip-engaging nub 2*d* engages with the engaging protuberance 6*b* of the slide body 6 and permitting the contact surface to be depressed down to the above position. In the safety operation, the clip 2*a* is lifted up to disengage the engaging protuberance 6*b* of the slide body 6 from the engaging nub 2*d* at the end of the clip 2*a* at a position where there is no play. Therefore, the distance h of the first vertical motion of FIG. 10D is equal to the distance f of the first vertical motion of FIG. 9B of the second embodiment.

FIGS. 12A to 12D illustrate an example (trial model) in comparison with the embodiments of the invention. The comparative example is concerned with a writing instrument having a safety function but without having the above shock-relaxing measure. No step is formed on the second tilted surface of an inner cylinder cam 2*b*', and one time of vertical motion takes place either in the return operation or the safety operation. Table 1 shows distances g, i thereof and the numbers of bubbles evolved.

In the above constitution, the vertical motion occurs at one place and it is attempted to relax the shock by the deceleration at the portion of a tilted surface 2*h'* of the inner cylinder cam 2*b*'. However, the vertical motion of one time (distance g in the return operation, distance i in the safety operation) produces a large shock of collision, and the effect for relaxing the shock is not sufficient.

As compared to the constitution of the above comparative example, the second and third embodiments (FIG. 8A to FIG. 10D) form a step in the axial direction on the second tilted surface of the inner cylinder cam 2*b* to divide it into the front half and the rear half. Namely, in the drawings, the height of the front half tilted surface is increased, the vertical wall of the holder cam 1*a* is shortened, and a gap is maintained through which the cam protuberance 3*b* passes in the safety operation.

TABLE 1

| Type | | First vertical motion (mm) | Second vertical motion (mm) | Number of bubbles evolved |
|---|---|---|---|---|
| Conventional Kahn's knock type | | a = 6 | | 33 |
| First embodiment (without safety) | | b = 3 | c = 1.5 | 1.6 |
| Second embodiment (with safety) | In return operation | d = 3 | e = 1.5 | 1.6 |
| | In safety operation | f = 2 | e = 1.5 | 1.0 |
| Third embodiment (with safety) | In return operation | d = 3 | e = 1.5 | 1.6 |
| | In safety operation | h = 2 | e = 1.5 | 1.0 |
| Comparative example (with safety) | In return operation | g = 4.5 | | 3.3 |
| | In safety operation | i = 3 | | 1.2 |

According to the embodiments 1 to 3 as shown in Table 1, the distance of one time of vertical motion of the cam protuberance 3*b* is shortened as compared to that of the conventional constitution, and the shock of collision on the tilted cam surface is relaxed correspondingly. Comparison of the numbers of bubbles evolved with those of the conventional constitution shows that the shocks are relaxed in the embodiments 1 to 3.

As described above, the present invention makes it possible to relax the shocks at the time of return operation and safety operation and to provide a knock-type writing instrument that does not permit the occurrence of ink leakage or blurred writing by using a decreased number of parts and even by using an aqueous ink or a gel ink.

LIST OF REFERENCE NUMERALS

1—holder
1*a*—holder cam
2—inner cylinder
2*a*—clip
2*b*—inner cylinder cam
2*c*—grooves
2*d*—engaging nub
2*e*—first tilted surface
2*f*—second tilted surface
2*g*—front half tilted surface
2*h*—rear half tilted surface
2*i*—groove for slide body cam
3—rotor
3*a*—knock cam
3*b*—cam protuberance
4—knock rod
4*a*—knock rod cam
4*b*—turn stop
5—spring
6—slide body
6*a*—slide body cam
6*b*—engaging protuberance
7—refill

The invention claimed is:

1. A knock-type writing instrument comprising a refill having a writing portion at a front end thereof, a spring for urging the refill backward, and a knock rod that is arranged at the back of said refill and is linked to said refill and protrudes beyond the rear end of a holder, wherein upon depressing said knock rod, the refill is brought to a writing position protruding beyond the front end of said holder and an engaging nub of a clip is engaged with an engaging protuberance of a slide body to maintain said writing position; and wherein a rotor is provided between said knock rod and the refill to support the refill, the knock rod and said rotor have tilted cam surfaces for rotation corresponding to each other, and the rotor rotates in only one direction by only a predetermined angle each time due to the reactive force of said spring and responsive to the knocking operation forward and backward in the axial direction;

when the knocking operation is effected in a state where the refill has been drawn back into the holder, a tilted cam surface for positioning formed on the side surface of a cylindrical portion of the rotor comes in contact with a first tilted surface of the cam formed in an inner cylinder corresponding thereto and with a tilted cam surface formed on the slide body successively, and a vertical surface of the cam for positioning of the rotor comes in contact with a vertical wall of a cam formed in the holder and maintains the refill at a writing position being supported by the load in the axial direction and by the rotational force;

when the knocking operation is effected in a state where the refill is at the writing position, said tilted cam surface for positioning of the rotor comes in contact with a tilted cam surface formed in the holder and, further, rotates upon coming in contact with a second tilted surface of the cam formed in the inner cylinder, and moves to a retreated limit position to maintain the refill at the holding position;

the slide body that can move in the lengthwise direction has an inward protuberance in a cut-away portion of the holder and when the refill is at the writing position, said inward protuberance is brought into engagement with a rear end of the cam for positioning of the rotor, and an engaging protuberance formed on the slide body engages with an engaging step formed in a clip body to maintain the refill at the writing position;

when the engagement is released between said engaging protuberance of the slide body and said engaging step of the clip body, the refill is returned by the spring back to the retreated position together with the slide body, and the positioning cam of the rotor moves to the retreated limit position passing through a gap formed at the back of the tilted cam surface of the holder to maintain the refill at the holding position;

wherein the second tilted surface of said cam formed in the inner cylinder has a step in the axial direction.

* * * * *